US005449317A

United States Patent [19]

Takessian

[11] Patent Number: 5,449,317

[45] Date of Patent: Sep. 12, 1995

[54] GRINDING AND CUTTING GUIDE ASSEMBLY FOR HAND HELD SHAPING TOOL

[76] Inventor: Karabet Takessian, 24024 Evergreen Rd. Apt. 147C, Southfield, Mich. 48075

[21] Appl. No.: 257,023

[22] Filed: Jun. 8, 1994

[51] Int. Cl.[6] ..... B24B 23/00

[52] U.S. Cl. ..... 451/558; 451/457; 451/439

[58] Field of Search ..... 51/205 WG, 208, 210, 51/274, 268, 262 R, 241 S, 241 G, 241 A, 170 PT; 451/558, 545, 549, 457, 451, 442, 439, 438, 431, 358

[56] References Cited

U.S. PATENT DOCUMENTS

| | | | |
|---|---|---|---|
| 1,785,065 | 12/1930 | Aborn | 51/170 PT |
| 2,238,304 | 4/1941 | Belanger | 144/136 |
| 2,906,067 | 9/1959 | Hale | 51/170 PT |
| 2,923,303 | 2/1960 | Hundt | 51/170 PT |
| 2,973,576 | 3/1961 | Hentke | 51/170 PT |
| 2,978,931 | 4/1961 | Broden | 77/7 |
| 3,779,663 | 12/1973 | Ruggles | 408/113 |
| 4,113,404 | 9/1978 | Lippacher | 408/202 |
| 4,156,990 | 6/1979 | Rutkowski | 51/170 PT |
| 5,138,797 | 8/1992 | Siden | 51/102 |
| 5,152,644 | 10/1992 | Mathews | 409/181 |

*Primary Examiner*—Robert A. Rose
*Attorney, Agent, or Firm*—Andrew E. Pierce

[57] ABSTRACT

A drilling, grinding, and shaping guidance assembly particularly suited for attachment to a precision jewelers' grinding and cutting handpiece. The guidance assembly is integrally attached or clamped on the jewelers' handpiece. The guide arms of the assembly have desirably shaped terminal portions adapted for engaging a workpiece which permits specific cutting or grinding tasks to be performed more accurately than can be performed without the guide arms.

8 Claims, 4 Drawing Sheets

GRINDING AND CUTTING GUIDE ASSEMBLY FOR HAND HELD SHAPING TOOL

BACKGROUND OF THE INVENTION

1. Field of the Invention

This invention relates to a guidance assembly for attachment to a shaping tool or an assembly which may be integral with a shaping tool used for cutting, deburring, trimming, and removing edges or fins and the like of workpieces, more particularly, to a jeweler's cutting or grinding assembly for use in setting gemstones.

2. Description of the Prior Art

Jewelers' flexible shaft handpieces which can be used for gem setting, undercutting, and texturing are commonly provided without a guiding assembly necessitating that the operator exercise manual control of the guidance of the driven drill or bur which performs the cutting of the workpiece. Tools for deburring, chamfering, trimming, and removing edges of workpieces are disclosed in U.S. Pat. No. 4,279,554. A tool for trimming of edges is disclosed in U.S. Pat. No. 4,504,178. Neither of these tools are used in association with an attachment which guides the cutting, deburring, or chamfering action of the drill or bur. A grinding guide assembly for a hand-held grinding machine for buttons used with a button drill bit is disclosed in U.S. Pat. No. 5,138,797. The hand-held grinding machine disclosed in this patent can be driven pneumatically, hydraulically or electrically depending upon the power source available at the site where the machine is used. The proper grinding of buttons requires that the operator be able to rotate the drilling machine around the button at the grinding point while the grinding machine is operated. Accordingly, it is necessary to hold the grinding disc centered on one single point in relation to the button. This cannot be achieved with a conventional hand-held grinding machine, therefore, necessitating the use of a grinding guide assembly.

A drill stop for determining the depth of holes drilled by an electric hand drill is disclosed in U.S. Pat. No. 2,978,931. A cutting tool adapted to be manually guided over the surface of a work piece is disclosed in U.S. Pat. No. 2,238,304 and a guide for a precision shaping tool is disclosed in U.S. Pat. No. 5,152,644.

Similarly, the highly accurate setting of precious stones, whether channel, bead, or prong setting.; which may involve the undercutting of a channel in the workpiece has been difficult to achieve simply by using conventional hand-held drills and burs mounted upon flexible shaft handpieces.

SUMMARY OF THE INVENTION

A cutting and grinding guide assembly for a hand-held grinding or cutting machine is disclosed. The grinding or cutting guide assembly can be integral or attached by clamping to a jewelers' handpiece or grinding machine, for instance, a flexible shaft handpiece which operates at high speed, one end of which is attached to a flexible drive shaft and the other end of which has a mechanism for holding, a drill or bur which is rotated for cutting or grinding of the workpiece. A feature of the invention is the provision for extension and retraction and vertical adjustment of the guide arm and a provision for the attachment of different guiding arms to the body of the cutting or grinding guide assembly. Guiding arms having terminal portions exhibiting various contours can be utilized which allow specific cutting or grinding tasks to be performed with high accuracy as compared to tasks performed without the use of the inventive cutting and grinding guide assembly. In one embodiment of the invention, provision is made for quick release of the guide arm assembly.

BRIEF DESCRIPTION OF THE FIGURES

The objects and the advantages of the present invention will be more clearly understood when considered in conjunction with the accompanying drawings in which.

Partial perspective views of the terminal portions of various guide arms suitable for attachment to the grinding guide assembly of the invention are shown in FIGS. 5–20. The various guide arms have contours on the terminal portions of the guide arm which are adapted to engage the workpiece thus permitting highly accurate grinding and cutting operations.

Figure 21:
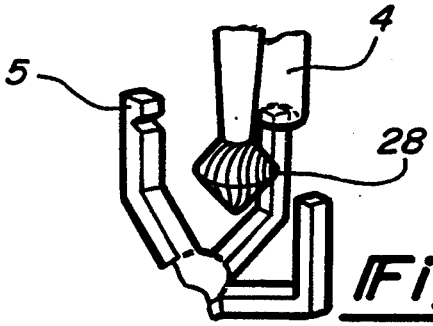
Figure 22:
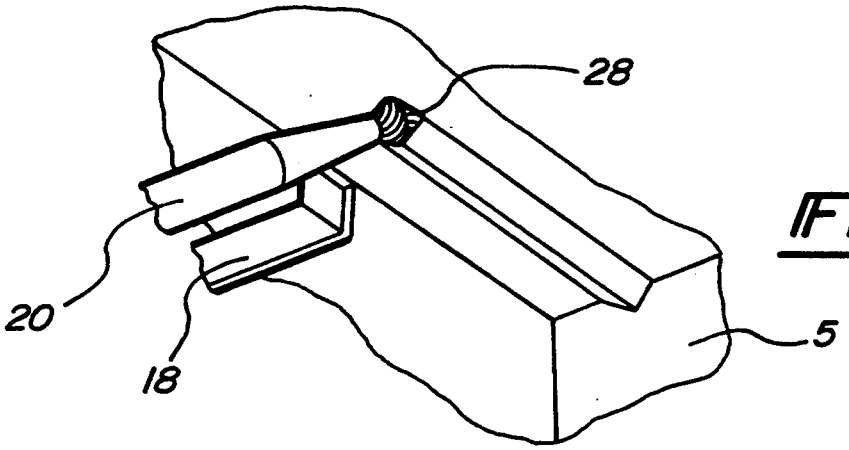
Figure 23:
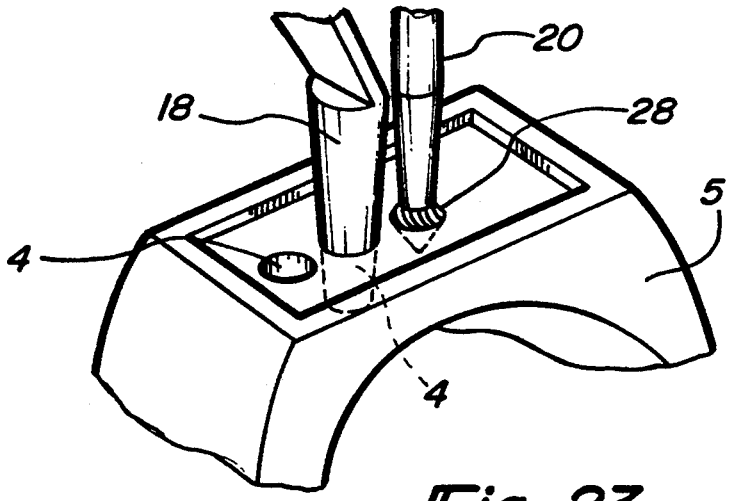

FIGS. 21–23 are partial perspective views showing various operations using a guide arm to obtain accurate cutting results.

DETAILED DESCRIPTION OF THE INVENTION

It is an object of the present invention to provide a grinding and cutting guide assembly for a grinding and cutting handpiece. It is an additional object of the invention to provide a grinding and cutting guide assembly particularly useful in undercutting, trimming, and shaping of jewelry workpieces to permit gemstone and bead setting in metals and other materials adapted for use as jewelry. This is accomplished by attaching a guide arm to a handpiece so as to permit the operator to accurately position a bur on the workpiece. Cutting or grinding is accomplished more accurately by use of the guide assembly of the invention than can be accomplished without such guide assembly.

DETAILED DESCRIPTION OF THE DRAWINGS

Figure 1:
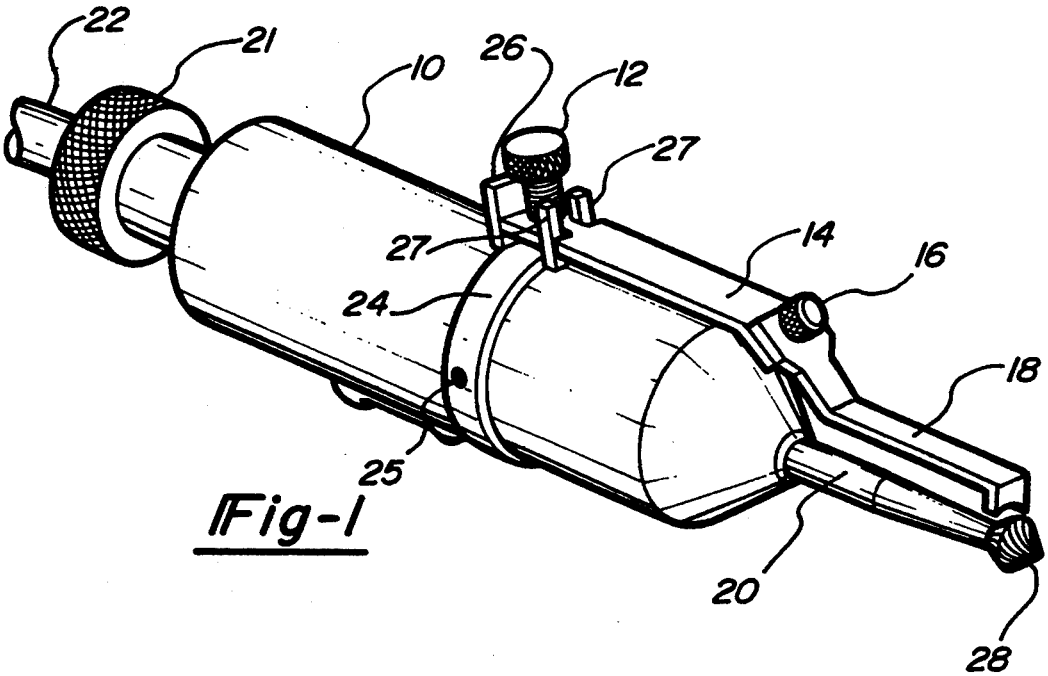
FIG. 1 is a perspective view of one embodiment of a flexible shaft handpiece having attached thereto a cutting and grinding guide assembly of the invention which is particularly adapted for use in grinding and cutting of jewelry, more particularly, the setting of gemstones in jewelry, i.e., rings, necklaces, etc. The handpiece is provided with a grinding and cutting guide assembly which in this embodiment is adapted to be attached to the handpiece by a collar or ring which can be tightened so as to provide a secure and rigid handpiece and guide assembly. The grinding and cutting guide assembly has a guiding arm one end of which is adapted to engage the workpiece and being particularly suited for the particular grinding or cutting work to be performed. The grinding guide arm is removably attached at the opposite end. By appropriately contouring the end of the guiding arm which engages the workpiece, highly accurate cutting, grinding, and deburring can be accomplished, permitting highly accurate gemstone and bead setting. A degree of accuracy in setting gem stones is obtained not heretofore achieved by methods in the prior art.

In FIG. 1, in one embodiment of the invention, a flexible shaft driven handpiece 10 is attached by knurled collar 21 to flexible drive shaft 22 so as to drive bur 28 integrally attached at the end of shaft 20. Grinding guide arm 18 is attached to extension arm 14 by hand tightening knurled head bolt 16. Extension arm 14 is fixedly attached to collar 24 by hand tightening knurled head bolt 12 and resists horizontal movement by placement between posts 27 and resists longitudinal movement along the longitudinal axis of handpiece 10 by abutment against plate 26. Collar 24 is tightened against handpiece 10 by set screw 25 which is threaded into handpiece 10.

Figure 2:
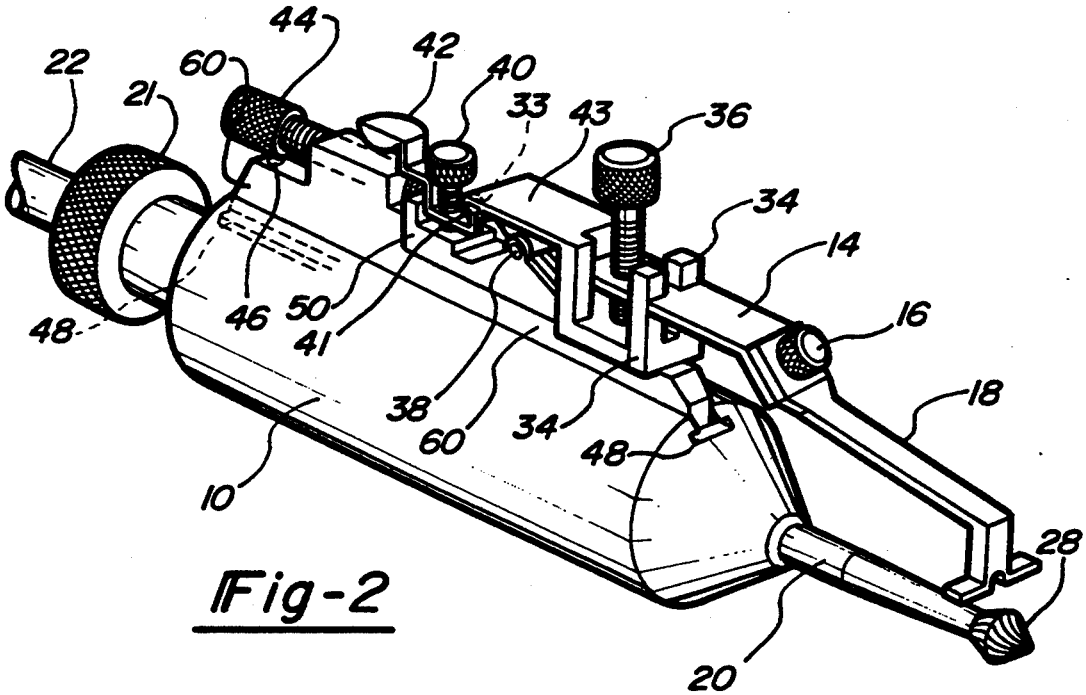
FIG. 2 is a perspective view of another embodiment of a flexible shaft handpiece having a guide assembly attached by channel means to the handpiece. This embodiment of the invention includes an adjustable screw means for moving the guiding arm along the length of the flexible shaft handpiece so as to permit precise engagement of the contoured terminal portion of the guide arm on the FIG. 3 is a side elevational view of the grinding guide assembly of the invention shown in FIG. 2. The guide assembly is shown as having screw means to move the guide arm both longitudinally and vertically in relation to the position of the handpiece so as to provide precise engagement of the contoured terminal portion of the guiding arm on the workpiece. In addition, a quick release mechanism is shown which allows vertical movement of the guide arm.

In FIG. 2, another embodiment of the invention is shown which, in addition to guide arm 18, knurled head bolt 16, extension arm 14, shafts 20 and 22, bur 28, handpiece 10, and knurled collar 21 shown in the grinding guide assembly of FIG. 1, contains an additional screw means 44 for moving the guide arm along the longitudinal axis of handpiece 10, an additional screw means 36 for moving the guide arm in a direction normal to a horizontal plane of handpiece 10, and a quick release mechanism 42 and 43. Rotation of latch 42 pivotably around knurled head bolt 40 results in release of quick release assembly section 43 by movement of latch extension arm 41 out of engagement in track 33. Knurled head bolt 44 is threaded into base 60 which is retained in channel 48 and held in a fixed position by set screw 46. On carrier assembly 50 there is attached the quick release assembly 42 and 43. A hinge at 38 allows vertical movement of guide arm 18 away from bur 28, as shown in dotted lines on FIG. 3. Guide arm 18 can be lowered or raised between posts 34 by tightening or loosening knurled head bolt 36, the shaft of which is retained by collar 35 which is shown in FIG. 3.

Figure 3:
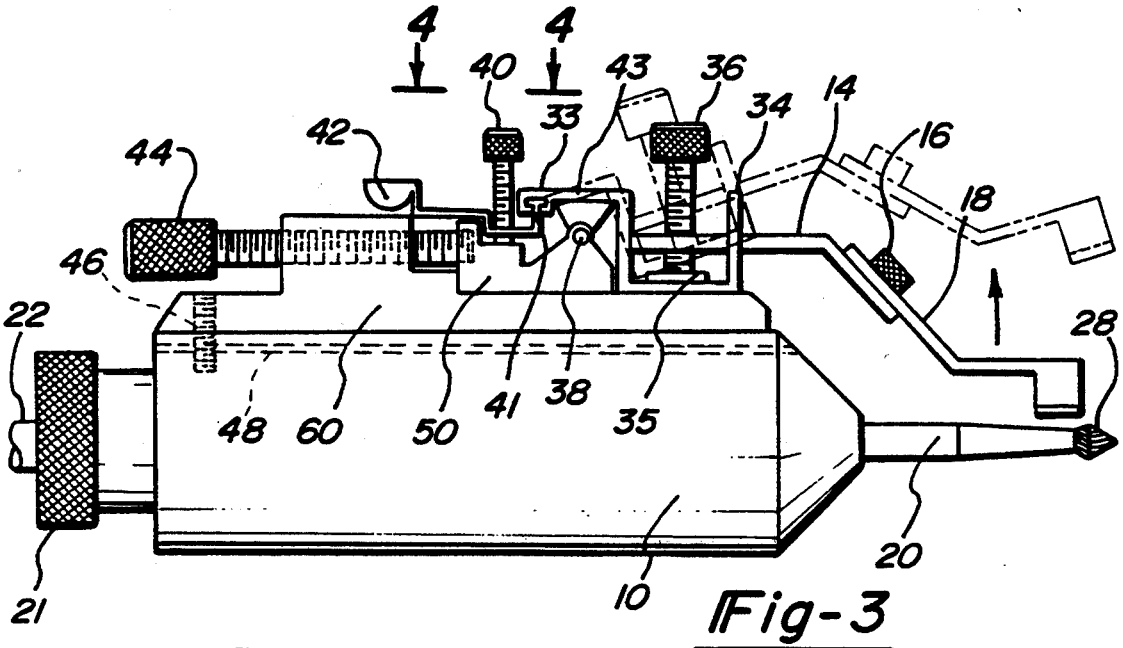

FIG. 3 is a side elevational view of the guide assembly of the invention shown in FIG. 2 which illustrates in greater detail quick release assembly 42 and 43 which is adapted to provide quick release of the guide arm so as to permit ease of changing the bur or guide arm to suit the particular cutting or grinding action to be performed. Set screw 46 which is threaded into handpiece 10 together with channel 48 attaches base 60 to handpiece 10. Vertical movement of guide arm 18, as shown in broken lines, is permitted upon rotation of latch 42 around knurled head bolt 40 which frictionally engages at 41 a channel 33 cut in the undersurface of quick release assembly 43. Precise vertical adjustment of guide arm 18 which is attached to guide arm extension 14 by knurled head bolt 16 and retained between posts 34 is accomplished by turning knurled head bolt 36 which is threaded through guide arm extension 14 and is retained by collar 35, so that extension arm 14 is caused to rotate around hinge 38 up or down as desired. Precise adjustment of guide arm 18 along the longitudinal axis of handpiece 10 is accomplished by turning knurled head bolt 44 which is threaded into base 60 and retained in base 50.

Figure 4:
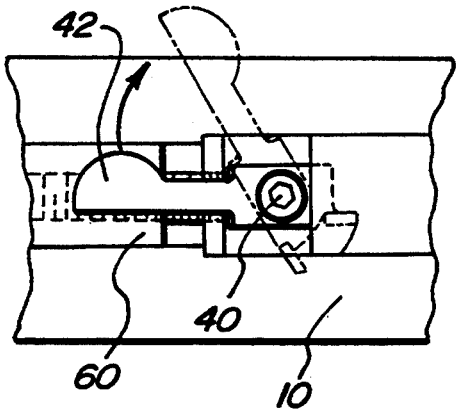
FIG. 4 is a plan view of a portion of thee assembly of FIG. 3 indicated as view 4/4 in FIG. 3. The attachment and locking assembly shown in FIG. 4 permits quick release and vertical movement of the guide arm so as to permit the guide arm and the bur to be changed easily and quickly.
Figure 5:
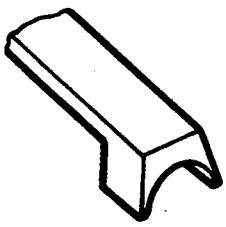
Figure 6:
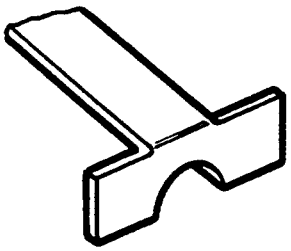
Figure 7:
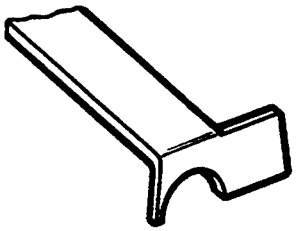
Figure 8:
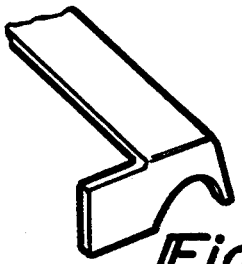
Figure 9:
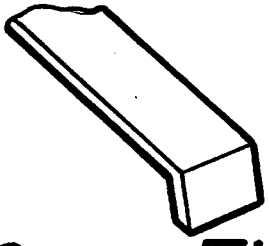
Figure 10:
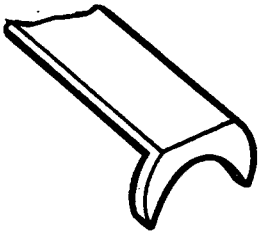
Figure 11:
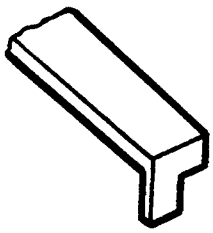
Figure 12:
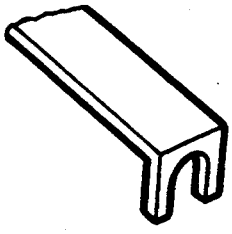
Figure 13:
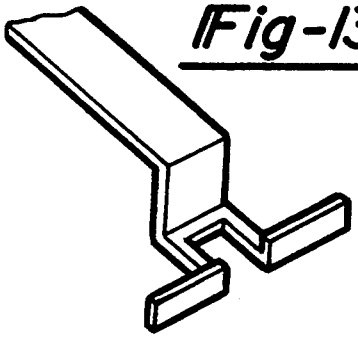
Figure 14:
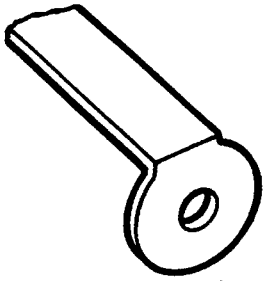

Latch 42 shown in a plan view in FIG. 4 is attached to base 60 by knurled head screw 40 which is threaded into base 50. In FIG. 4 latch 42 is shown in a plan view taken in the direction of 4/4 of FIG. 3. Release of latch 42 moves the channel engaging portion of latch 42 out of engagement.

Figure 15:
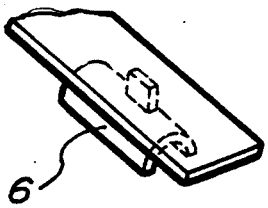
Figure 16:
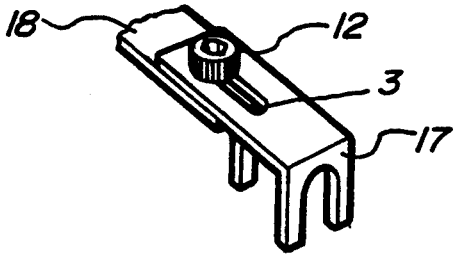
Figure 17:
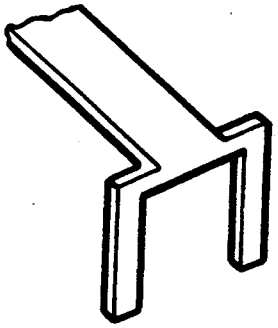
Figure 18:
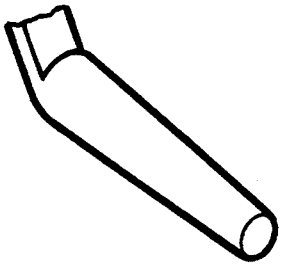
Figure 19:
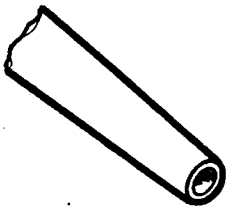
Figure 20:
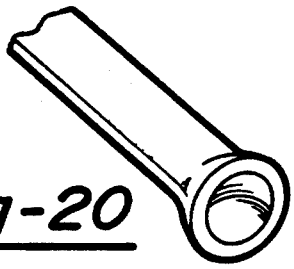

In FIGS. 5–20, various guide arms are shown with contoured shapes adapted to be used for various types of cutting or grinding. The guide arms shown in FIGS. 5–11 and 13 are useful as guides for cutting channels in pieces of jewelry to allow the setting of precious stones with a precision not heretofore obtained. The guide arms shown in FIGS. 12, 14–17, 19, and 20 are useful as guides for cutting prongs in ring settings for insertion of precious stones. In FIG. 15, horizontal cut depth in cutting a prong setting is provided by placement of the half tubular section 6 behind the prong to be cut. Control of vertical cut depth is manually controlled. In FIG. 16, horizontal cut depth is fixed but vertical cut depth in cutting a prong setting is provided by loosening knurled head bolt 2 which is threaded into guide arm 18 so as to permit adjustment of guide arm extension 17 by movement along the length of the slotted portion thereof 3. The guide arm of FIG. 18 is useful in drilling holes so as to obtain holes which are a uniform distance apart. The holes can be filled with precious stones or beads. FIG. 21 shows prong cutting to a predetermined depth using the guide arm of FIG. 19. FIG. 22 shows grinding guide 18 in operation engaged in workpiece 5. Bur 28 is accurately positioned by the engagement of grinding guide 18 against workpiece 5. FIG. 23 shows workpiece 5 and guide arm 18 in place adjacent to bur 28 and shaft 20. Previously drilled holes are shown as 4.

Various embodiments of the invention have now been described in detail. Since it is obvious that many changes in and additions to the above-described preferred embodiments may be made without departing from the nature, spirit and scope of the invention, the invention is not to be limited to said details, except as set forth in the appended claims.

What is claimed is:

1. In a shaping machine driven by a flexible shaft and motor means, said machine comprising a body, a shaft rotatably mounted on said body, and a cutting bur on a free end of said shaft, the improvement consisting of a guidance assembly comprising a single guide arm adapted for guiding said bur in at least two dimensions, said single guide arm both longitudinally and vertically adjustable and adapted for quick release from said guidance assembly by a quick release means, said quick release means being pivotable about said guidance assembly from a locking position in locking engagement with said guide arm to a release position, allowing said guide arm to be removed, said single guide arm terminating on a free end in a contoured shape, workpiece engaging member, whereby precise definition of a specific workpiece area to be cut by said bur is obtained by contact of said workpiece engaging member on said workpiece.

2. The guidance assembly of claim 1 wherein said guide arm is detachably mounted to said machine and adjustable along the longitudinal axis of said machine by screw means and is adapted for cutting a piece of jewelry.

3. The guidance assembly of claim 1 wherein said guide arm is vertically adjustable by screw means along a line normal to a horizontal plane of said machine and wherein said machine is adapted for cutting a channel or opening in a piece of jewelry permitting the setting of a precious stone.

4. The guidance assembly of claim 3 wherein said guide arm is both longitudinally and vertically adjustable by screw means and is adapted for bead setting, channel setting, or prong setting of a precious stone in a piece of jewelry.

5. In a shaping machine driven by a flexible shaft and motor means, said machine comprising a body, a shaft rotatably mounted on said body, and a cutting bur on a free end of said shaft, the improvement consisting of a guidance assembly comprising a single guide arm adapted for guiding said bur in three dimensions, removably attached on said body, said single guide arm adapted for quick release by a quick release means, said quick release means being pivotable about said guidance assembly from a locking position in locking engagement with said guide arm to a release position, allowing said guide arm to be removed, and said single guide arm terminating on a free end in a contoured shape, workpiece engaging member whereby precise definition of three dimensions of a specific workpiece area to be cut by said bur is obtained by contact of said engaging member with said workpiece.

6. In a jeweler's shaping machine adapted for channel setting, bead setting, and prong setting and mechanically driven by a flexible shaft and motor means, said machine comprising a body, a shaft rotatably mounted on said body, and a cutting bur on a free end of said shaft, the improvement consisting of a guidance assembly adapted for quick release by a quick release means, said guidance assembly consisting of A) a single guide arm removably attached on said body and supporting said machine, B) said guide arm terminating on a free end in a contoured shape, workpiece engaging member, C) said guide arm adapted for supporting said machine and guiding said bur so as to obtain precise definition of two dimensions of an area to be cut by said bur upon contact of said engaging member with a workpiece area adjacent to an area to be cut by said bur, D) said quick release means being pivotable about said guidance assembly from a locking position in locking engagement with said guide arm to a release position, allowing said guide arm to be removed, E) wherein said guide arm is vertically and longitudinally adjustable by screw means.

7. The shaping machine of claim 5 whereto said guidance assembly is vertically adjustable by screw means along a line normal to a horizontal plane of said machine.

8. The shaping machine of claim 7 wherein said guide arm is both longitudinally and vertically adjustable by screw means.

* * * * *